US008439322B2

(12) United States Patent
Skudin et al.

(10) Patent No.: US 8,439,322 B2
(45) Date of Patent: May 14, 2013

(54) APPARATUS AND METHOD FOR MOUNTING OF CABINETS

(75) Inventors: Michael E. Skudin, Little Rock, AR (US); Dennis D. Davis, Sheridan, AR (US); David W. Willis, Franklin, IN (US)

(73) Assignees: Windstream Intellectual Property Services, Inc., Little Rock, AR (US); General Devices Co., Inc., Indianapolis, IN (US)

( * ) Notice: Subject to any disclaimer, the term of this patent is extended or adjusted under 35 U.S.C. 154(b) by 0 days.

(21) Appl. No.: 13/118,133

(22) Filed: May 27, 2011

(65) Prior Publication Data

US 2011/0290957 A1 Dec. 1, 2011

Related U.S. Application Data

(60) Provisional application No. 61/350,398, filed on Jun. 1, 2010.

(51) Int. Cl.

| | |
|---|---|
| ***A47B 96/00*** | (2006.01) |
| ***A47B 97/00*** | (2006.01) |
| ***A47B 81/00*** | (2006.01) |
| ***A47B 91/00*** | (2006.01) |
| ***A47G 29/00*** | (2006.01) |
| ***A47G 23/02*** | (2006.01) |
| ***A47K 1/00*** | (2006.01) |
| ***A47H 1/10*** | (2006.01) |

(52) U.S. Cl.

USPC ..... 248/317; 248/219.2; 248/507; 248/318; 248/342; 248/146; 248/147; 248/176.1; 248/676; 248/677; 312/10.1; 312/245; 312/223.2; 312/351.2; 312/351.1

(58) Field of Classification Search ..... 248/317, 248/551, 219.2, 507, 318, 342, 343, 146–147, 248/176.1, 676–677, 351, 357; 312/242, 312/10.1, 245, 223.2, 351.2, 351.1

See application file for complete search history.

(56) References Cited

U.S. PATENT DOCUMENTS

| | | | | | |
|---|---|---|---|---|---|
| 1,929,677 | A | * | 10/1933 | Davis | 312/202 |
| 3,179,208 | A | * | 4/1965 | Umanoff | 186/40 |
| 3,295,671 | A | * | 1/1967 | Wuensch et al. | 206/763 |
| 3,561,719 | A | * | 2/1971 | Grindle | 248/343 |
| 3,801,055 | A | * | 4/1974 | Stenger | 248/176.1 |
| 3,822,051 | A | * | 7/1974 | Karapita | 248/333 |
| 4,317,302 | A | * | 3/1982 | Von De Linde | 40/549 |
| 4,964,606 | A | * | 10/1990 | Beam et al. | 248/333 |
| 5,094,174 | A | * | 3/1992 | Grund et al. | 108/153.1 |
| 5,103,768 | A | * | 4/1992 | Slowinski | 119/428 |
| 5,362,019 | A | * | 11/1994 | Swanson | 248/146 |
| 5,490,655 | A | * | 2/1996 | Bates | 248/329 |
| 5,551,658 | A | * | 9/1996 | Dittmer | 248/329 |
| 6,017,104 | A | * | 1/2000 | Foschino | 312/205 |
| 6,019,325 | A | * | 2/2000 | Dotson et al. | 248/121 |

(Continued)

*Primary Examiner* — Terrell McKinnon
*Assistant Examiner* — Christopher Garft
(74) *Attorney, Agent, or Firm* — Bryan Cave LLP

(57) ABSTRACT

A mounting post for supporting a plurality of electronic cabinets, each having different bolt patterns, comprising a hollow post configured to receive a hollow mount at the upper end, a stabilizer plate attached to the lower end of the post, and a hollow mount selected from a plurality of hollow mounts, each having a lower end configured to mate to the post, and having a substantially planar upper surface with openings formed therein corresponding to a unique bolt pattern for an electronics cabinet.

7 Claims, 2 Drawing Sheets

U.S. PATENT DOCUMENTS

| | | | | |
|---|---|---|---|---|
| 6,311,943 | B1 * | 11/2001 | Tang | 248/343 |
| 6,708,940 | B2 * | 3/2004 | Ligertwood | 248/324 |
| 7,156,359 | B2 * | 1/2007 | Dittmer et al. | 248/551 |
| 7,163,141 | B1 * | 1/2007 | Parker | 232/39 |
| 7,448,531 | B1 * | 11/2008 | Bolles | 232/39 |
| 7,481,410 | B2 * | 1/2009 | Umberg | 248/551 |
| 2003/0066463 | A1 * | 4/2003 | Acevedo et al. | 108/50.02 |
| 2005/0127259 | A1 * | 6/2005 | Riker | 248/219.2 |
| 2005/0139742 | A1 * | 6/2005 | Frisell | 248/317 |
| 2006/0266908 | A1 * | 11/2006 | Tong | 248/339 |
| 2006/0284046 | A1 * | 12/2006 | Umberg | 248/551 |
| 2007/0034764 | A1 * | 2/2007 | Dittmer et al. | 248/324 |
| 2007/0034765 | A1 * | 2/2007 | Lo | 248/343 |
| 2007/0057607 | A1 * | 3/2007 | Caissie | 312/265.6 |
| 2008/0203250 | A1 * | 8/2008 | Blok | 248/158 |
| 2010/0017952 | A1 * | 1/2010 | Thweatt, Jr. | 4/493 |
| 2011/0109883 | A1 * | 5/2011 | Ito | 353/61 |

* cited by examiner

APPARATUS AND METHOD FOR MOUNTING OF CABINETS

CROSS-REFERENCE TO RELATED APPLICATIONS

This application claims benefit of priority under 35 U.S.C. Section 119(e) to U.S. Provisional Application Ser. No. 61/350,398, filed Jun. 1, 2010, entitled "APPARATUS AND METHODS FOR MOUNTING OF CABINETS," which is hereby incorporated herein by reference.

BACKGROUND OF THE INVENTION

1. Field of the Invention

The present invention relates generally to exterior mounting of cabinets that house electronic devices commonly used to provide telecommunication services.

2. Description of the Related Art

Conventional methods for exterior mounting of cabinets that house electronic devices commonly used to provide telecommunication services include utility pole with mount kit, pre-cast pads, and site poured pads.

SUMMARY OF THE INVENTION

In accordance with various illustrative embodiments hereinafter described, the present invention is a device that may be used to mount cabinets that house electronic and electrical devices, such as the types commonly used to provide telecommunication services, in an outdoor environment. The present invention minimizes the costs and the depth profile of cabinet installations, while maximizing protection of both the cabinet and the cable associated with that installation. The present invention also comprises a two-piece pole and mount configuration that allows for the use of one of a variety of mounts that are configured to accommodate different electronics cabinet sizes and configurations to be installed on a single post design, thus minimizing manufacturing and inventory costs.

The invention can be used in lieu of utility pole with mount kit, H-Frame mounts, pre-cast pads, and site poured pads. The present invention thus reduces the overall cabinet footprint required when placing cabinet apparatus on right of ways ("ROWs"). The present invention also reduces labor costs and site preparation activities.

The present invention provides a mounting post to raise the electronics cabinet up off the ground, while keeping the overall depth of the total apparatus to a minimum. The present invention raises the electronics cabinet up off the ground by approximately 2 feet, making it easier to work on and less likely to get damaged from ROW mowers. The hollow post design provides for protection of the cabling routed in the interior, and requires less site preparation than other methods, as little to no leveling is required. The elongated slot in the side of the post allows cables to be routed through the post without impingement or abrasion. The top mount design allows for a minimum depth dimension and reduces manhours and equipment required because the 14" diameter post will fit into the hole drilled by a standard auger. The top mount design also allows for rear access into the cabinet, whereas traditional pole mount designs limited the types of cabinet configurations.

The stabilizer plate welded to the lower end of the tube provides stability and limits penetration and settling of the post into the soil, while the opening in the stabilizer plate allows for drainage of liquid from the lower end of the tube.

The access panel in the transition piece allows for ease of access in routing and installing cables from the post into the electronics cabinet.

The two piece pole and mount configuration allows for a variety of mounts that are configured to accommodate different electronics cabinet sizes and configurations to be installed on a single post design. The hollow mount design permits mating of cable entry openings for a variety of different cabinet configurations by selected use of openings from multiple different cabinet mounting bolt patterns in a single mount configuration.

BRIEF DESCRIPTION OF THE DRAWINGS

The above mentioned and other features and objects of this invention and the manner of attaining them will become more apparent and the invention itself will be better understood by reference to the following description of an embodiment of the invention taken in conjunction with the accompanying drawings.

DETAILED DESCRIPTION

Figure 1:
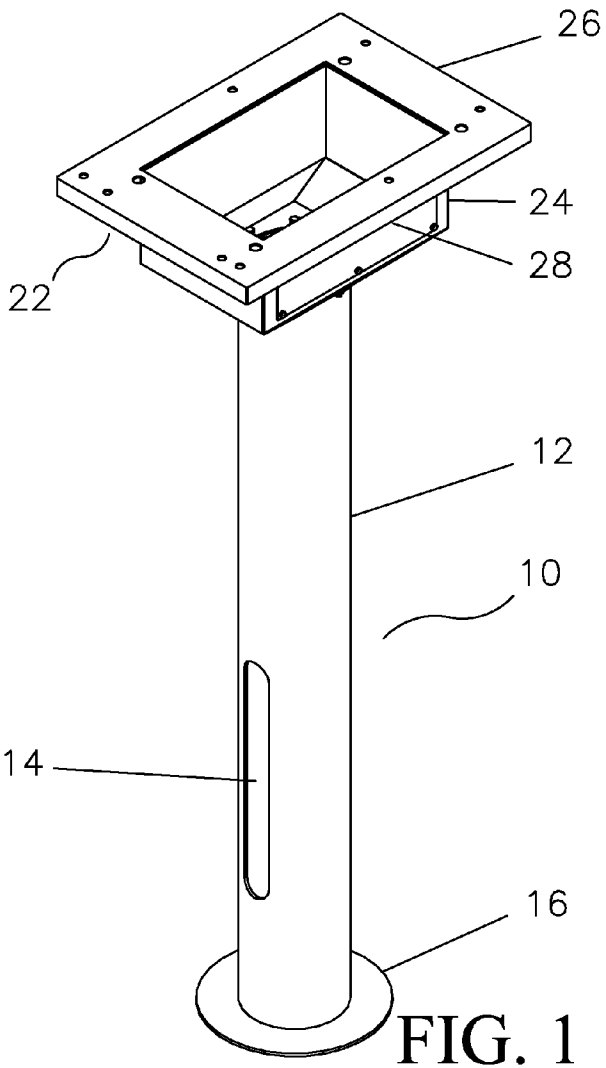
FIG. 1 is an overhead perspective view of the mounting post assembly according to one embodiment of the present invention.

The one embodiment, the present invention comprises a mounting post assembly configured to accommodate different cabinets. As illustrated in FIG. 1, in one embodiment, the mounting post 10 of the present invention is comprised of two sections; the tubular post 12 and the mounting assembly 22. The post 12 preferably consists of an eight inch diameter aluminum tube that is ¼ inch thick and 64.5 inches in length. There is a ¼ inch thick by 14 inch diameter stabilizer plate 16 welded to the lower end of the post 12.

Figure 2:
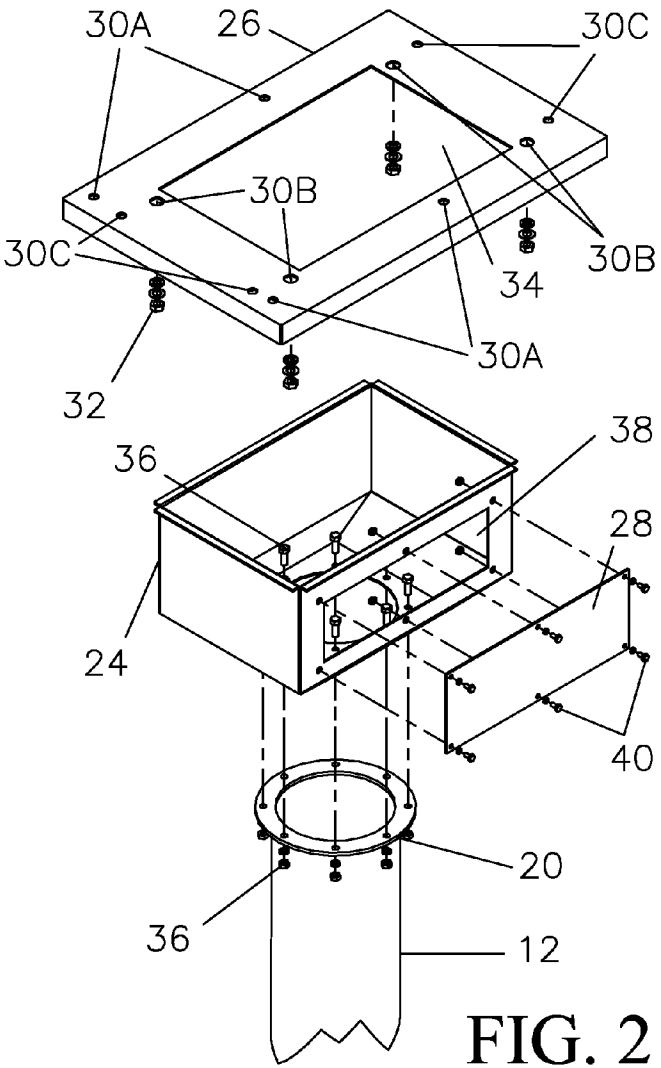
FIG. 2 is an exploded perspective view of the mounting post assembly according to one embodiment of the present invention.

As illustrated in FIG. 2, the post 12 has a mounting flange 20 welded to the upper end. Also as illustrated in FIG. 2, the mounting assembly 22 comprises a transition piece 24, which is preferably a 19.3 by 28.7 inch, 11 gauge platform which is bolted to the mounting flange 20 of tube 12 using flange bolts 36. As shown in FIG. 2, transition piece 24 has a circular central opening the bottom surface which conforms to the hollow interior of tube 12 to facilitate routing of the cables from the post 12 into the electronics cabinet. The transition piece 24 has a front access panel opening 38, which can be fitted with access panel covering 28, which is secured using access panel screws 40. The transition piece 24 is welded to mounting plate 26, which has multiple arrays of bolt openings 30A, 30B, and 30C to accommodate bolt patterns of popular cabinet installation configurations. Exemplar fasteners 32 for bolts corresponding to bolt opening array 30B are illustrated. As shown in FIG. 2, mounting plate 26 has a central opening to facilitate routing of the cables from the post 12 into the electronics cabinet.

Figure 3:
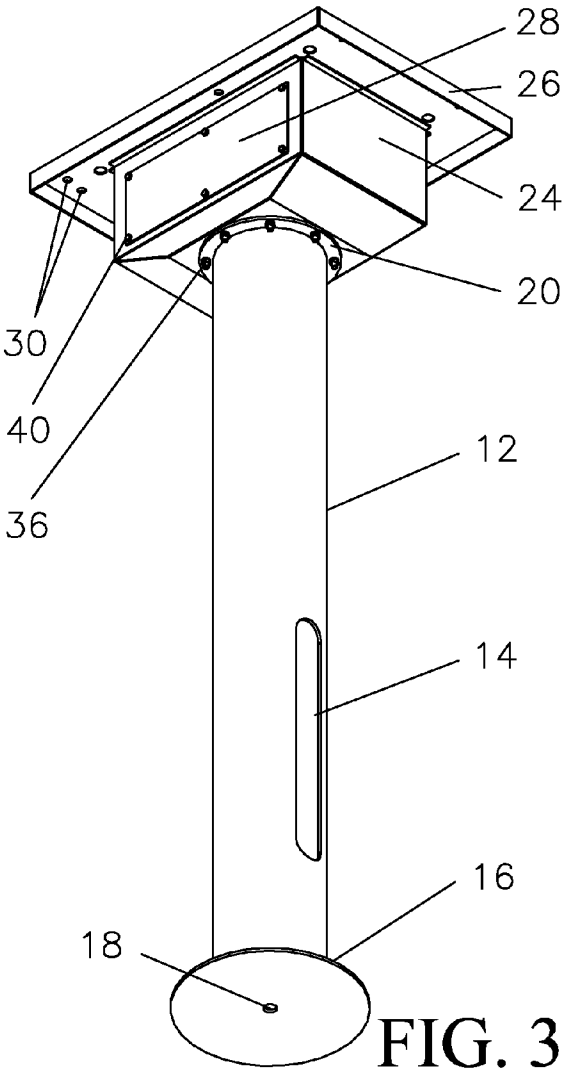
FIG. 3 is an underside perspective view of the mounting post assembly according to one embodiment of the present invention.

As illustrated in FIG. 3, the stabilizer plate 16 welded to the lower end of the tube provides stability and limits penetration and settling of the post 12 into the soil, while the opening 18 in the stabilizer plate allows for drainage of liquid from the lower end of the tube 12. The elongated slot 14 in the side of the post 12 allows cables to be routed through the post 12 and into the mounting assembly 22 without impingement or abrasion. Bolt openings 30 in the underside of mounting plate 26 are illustrated.

Figure 4:
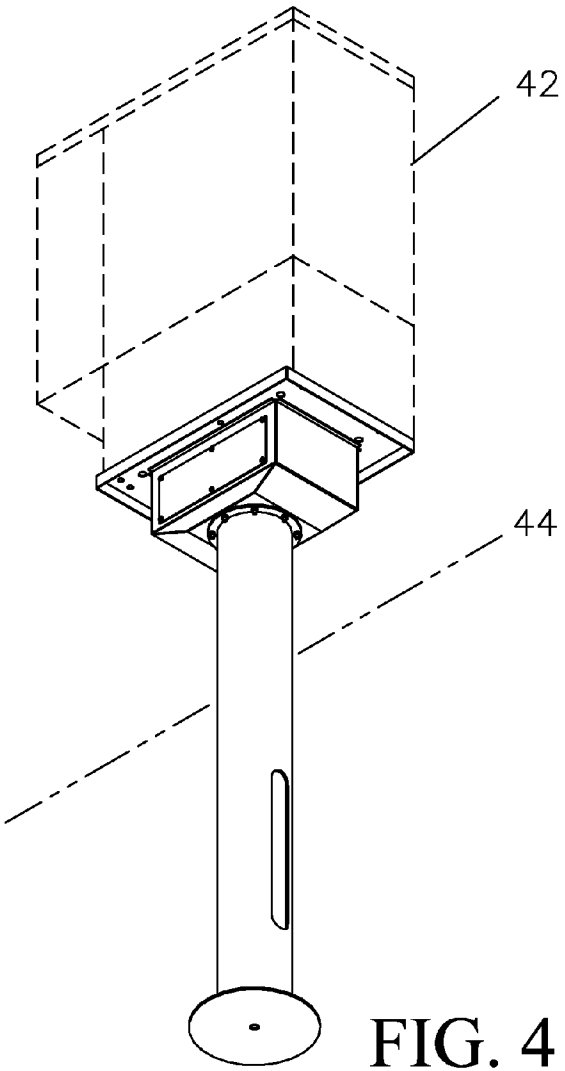
FIG. 4 is an underside perspective view of the mounting post assembly according to one embodiment of the present invention as installed in the ground with a commercially available cabinet bolted in place.

FIG. 4 illustrates the mounting post assembly according to one embodiment of the present invention as installed in the ground with a commercially available cabinet 42 bolted in place. As illustrated in FIG. 4, the stabilizer plate 16 limits penetration and settling of the post 12 into the soil 44.

The present invention may thus encompass a mounting post for supporting a plurality of electronic cabinets, each having different bolt patterns, comprising a hollow post configured to receive a hollow mount at the upper end, a stabilizer plate attached to the lower end of the post, and a hollow mount selected from a plurality of hollow mounts, each having a lower end configured to mate to the post, and having a substantially planar upper surface with openings formed therein corresponding to a unique bolt pattern for an electronics cabinet.

The present invention may also include a mounting post for supporting a plurality of electronic cabinets, each having different bolt patterns, comprising, a hollow post configured to receive a hollow mount at the upper end, a stabilizer plate attached to the lower end of the post, and a hollow mount having a lower end configured to mate to the post, and having a substantially planar upper surface with openings formed therein corresponding to a plurality of bolt patterns for an electronics cabinet.

Thus, in essence, the present invention comprises a method for supporting a plurality of electronic cabinets, each having different bolt patterns, comprising the steps of providing a hollow post configured to receive a hollow mount at the upper end, attaching stabilizer plate to the lower end of the post, and attaching to the post a hollow mount selected from a plurality of hollow mounts, each having a lower end configured to mate to the post, and having a substantially planar upper surface with openings formed therein corresponding to a unique bolt pattern for an electronics cabinet.

These examples are provided for the purposes of illustration and the present invention is not limited to them. Many changes, modifications, variations, combinations, subcombinations and other uses and applications of the subject invention will be and become apparent to those skilled in the art after considering this specification and the accompanying drawings, which disclose a preferred embodiment thereof. All such changes, modifications, variations, and other uses and applications that do not depart from the spirit and scope of the invention are deemed to be covered by the invention, which is to be limited only by the claims which follow.

What is claimed is:

1. A method for providing support and connections to a cable for a selected one of a plurality of electronic cabinets above an earth surface, each having different mounting bolt patterns, comprising the steps of:

providing a hollow post comprising:
- a side wall bounding an interior;
- an upper end;
- a lower end;
- an elongated slot in the side wall;
- a planar stabilizer plate on the exterior of the lower end; and
- a flange on the exterior of the upper end with a plurality of bolt holes formed therein;

embedding a portion of the post into the earth surface;

routing the cable from outside the post through the elongated slot into the interior of the post;

selecting a hollow mount having a set of openings corresponding to the mounting bolt pattern of the electronics cabinet from a plurality of hollow mounts, each having:
- a lower end with a central opening configured to conform to the interior of the post and a plurality of bolt holes configured to align with the bolt holes in the flange;
- a vertical side wall with an opening covered by a removable access panel; and
- a substantially planar upper surface with a central opening formed therein and a unique set of openings formed therein corresponding to a mounting bolt pattern for one of the plurality of electronics cabinets;

bolting the hollow mount to the upper surface of the flange using the bolt holes;

bolting the cabinet to upper surface of the hollow mount using the set of openings;

routing the cable through the interior of the post, the central opening in the lower end of the hollow mount, and the central opening in the upper surface of the hollow mount; and connecting the cable to the cabinet.

2. The method of claim 1, wherein the stabilizer plate extends inward from the side wall of the post to cover a portion of the interior of the post.

3. The method of claim 1, further comprising the step of drilling a hole in the earth surface using an auger.

4. The method of claim 1, further comprising the step of placing the removable access panel on the hollow mount.

5. The method of claim 1 wherein the step of connecting the cable to the cabinet is accomplished in part by obtaining access to the cable by use of the opening in the vertical wall of the hollow mount.

6. A method for providing support and connections to a cable for a selected one of a plurality of electronic cabinets above an earth surface, each having different mounting bolt patterns, comprising the steps of:

providing a hollow post comprising:
- a side wall bounding an interior;
- an upper end;
- a lower end;
- an elongated slot in the side wall;
- a planar stabilizer plate on the exterior of the lower end which extends inward from the post to cover a portion of the interior of the post; and
- a flange on the exterior of the upper end with a plurality of bolt holes formed therein;

drilling a hole in the earth surface using an auger;

embedding at least a portion of the post into the earth surface;

routing the cable from outside the post through the elongated slot into the interior of the post;

selecting a hollow mount having a set of openings corresponding to the mounting bolt pattern of the electronics cabinet from a plurality of hollow mounts, each having:
- a lower end with a central opening configured to conform to the interior of the post and a plurality of bolt holes configured to align with the bolt holes in the flange;
- a vertical side wall with an opening covered by a removable access panel; and
- a substantially planar upper surface with a central opening formed therein and a unique set of openings formed therein corresponding to a mounting bolt pattern for one of the plurality of electronics cabinets;

bolting the hollow mount to the upper surface of the flange using the bolt holes;

bolting the cabinet to upper surface of the hollow mount using the set of openings;

routing the cable through the interior of the post, the central opening in the lower end of the hollow mount, and the central opening in the upper surface of the hollow mount;

connecting the cable to the cabinet by obtaining access to the cable by use of the opening in the vertical wall of the hollow mount; and placing the removable access panel on the hollow mount.

7. A method for providing support and connections to a cable for a selected one of a plurality of electronic cabinets above an earth surface, each having different mounting bolt patterns, comprising the steps of:

providing a hollow post comprising:

a side wall bounding an interior;

an upper end;

a lower end;

an elongated slot in the side wall;

a planar stabilizer plate on the exterior of the lower end which extends inward from the side wall of the post to cover a portion of the interior of the post; and a flange on the exterior of the upper end with a plurality of bolt holes formed therein;

drilling a hole in the earth surface using an auger;

embedding at least a portion of the post into the earth surface;

routing the cable from outside the post through the elongated slot into the interior of the post;

selecting a hollow mount having a set of openings corresponding to the mounting bolt pattern of the electronics cabinet from a plurality of hollow mounts, each having:

a lower end with a plurality of bolt holes configured to align with the bolt holes in the flange;

a vertical side wall with an opening covered by a removable access panel; and a substantially planar upper surface with a unique set of openings formed therein corresponding to a mounting bolt pattern for one of the plurality of electronics cabinets;

bolting the hollow mount to the upper surface of the flange using the bolt holes;

bolting the cabinet to upper surface of the hollow mount using the set of openings;

routing the cable through the interior of the post, the central opening in the lower end of the hollow mount, and the central opening in the upper surface of the hollow mount;

connecting the cable to the cabinet by obtaining access to the cable by use of the opening in the vertical wall of the hollow mount; and placing the removable access panel on the hollow mount.

* * * * *